United States Patent [19]

Plath

[11] 3,934,083

[45] Jan. 20, 1976

[54] METHOD AND APPARATUS FOR PROCESSING THE INFORMATION CONTENT OF A PATTERN DRAWING IN CODED FORM

[75] Inventor: Ernst Dieter Plath, Tailfingen, Germany

[73] Assignee: Mayer & Cie., Tailfingen, Germany

[22] Filed: May 10, 1973

[21] Appl. No.: 359,262

Related U.S. Application Data

[63] Continuation-in-part of Ser. No. 342,623, March 19, 1973, abandoned.

[30] Foreign Application Priority Data

Mar. 25, 1972 Germany ..... 2214787

[52] U.S. Cl. ..... 178/6.6 R; 178/6.6 B; 178/6.7 R; 358/78; 360/79

[51] Int. Cl.[2] ..... H04N 5/76

[58] Field of Search ..... 178/6.6 R, 6.7 R, 6.6 B, 178/7.1, 7.3, DIG. 28, 7.6, DIG. 22; 360/79; 358/78

[56] References Cited

UNITED STATES PATENTS

| | | | |
|---|---|---|---|
| 1,973,539 | 9/1934 | Morton | 178/6.6 R |
| 2,154,512 | 4/1939 | Kleinschmidt | 178/6.6 R |
| 3,763,313 | 10/1973 | Doslik | 178/6.6 R |

OTHER PUBLICATIONS

NASA Tech. Brief, High Speed Television Camera System Processes Photographic Film data for Digital Computer Analysis.

*Primary Examiner*—Raymond F. Cardillo, Jr.

[57] ABSTRACT

Method and apparatus for processing the information content of a pattern drawing in coded form for application to an utilization facility such as a storage device for controlling textile machines. The pattern drawing is scanned line-by-line and point-by-point and the scanned points are projected in enlarged form so that the information content of the scanned points is comprehended by an operator who registers its, by pressing a corresponding information key, first of all in an intermediate storage device of limited capacity, the content of whose stages is made visible in corresponding adjacent fields in an optical indication device. The information of the intermediate storage device is transferred in groups to the storage device as soon as the intermediate storage is filled up.

8 Claims, 7 Drawing Figures

METHOD AND APPARATUS FOR PROCESSING THE INFORMATION CONTENT OF A PATTERN DRAWING IN CODED FORM

CROSS-REFERENCE TO RELATED APPLICATION

This is a continuation-in-part application of my copending application Ser. No. 342,623, filed Mar. 19, 1973, now abandoned.

This invention relates to a process of and an apparatus for transmitting the information content of a pattern drawing in coded form into a storage device, for example a program sheet or band, for controlling textile machines.

There have already been suggested several transmitting arrangements of this type, whhich are all provided with optical-electronic multi-color scanning heads. Although these arrangements automatically scan a pattern drawing, they must be adjusted to have the utmost sensitivity to differentiate between the several colors. This necessitates corresponding above-average demands as to the carefulness of execution of the pattern drawing. The pattern drawings, whose information contents are to be read, do not only have to be marked with the utmost exactness as to their contour, but also must have even coating of colors, so that the degree of reflection of the drawn surface is always the same. The pattern drawing should not be deformed, so that the scanning points, with which the multi-color scanning head is aligned, do not wander out of the middle of the scanning pattern fields. The pattern picture must therefore be drawn on a very expensive plastic foil, which does not deform but which forms a bad base for the adhesion for colors. Automatically working transmitting arrangements of the above-described type also create difficulties while reading free designed drawings by artists on uncheckered paper. Here, an automatic scanning arrangement frequently gets into difficulties with color transition points on the pattern drawing in deciding which color should be registered on a program sheet, band or other device on which the pattern drawing is to be reproduced for controlling a knitting machine. In this regard an arrangement has been suggested wherein at such color transition points, no color is registered, on the program sheet such unregistered points afterwards being filled in manually with a color pencil. On irregular patterns with many color transitions, imprinted program sheets are created with many white areas; the fill-in or repair work required involves a very considerable amount of time, which largely nullifies the advantages of an automatic arrangement due to the high cost of equipment.

It is an object of the invention to provide a process and arrangement with which a transmission of information can be achieved that is practically free of mistakes and is exactly controllable by avoiding the above-mentioned disadvantages of automatic arrangements and which requires a much lower cost expeniture. Although a slower transmitting velocity may be attained by use of the invention than that of fully automatic arrangements, a fault-free transmission is achieved.

According to the invention the pattern drawing is scanned line-by-line and point-by-point and the scanning points are projected in enlarged form, so that the information content of the scanning points is comprehended by an operator. Such information is registered by the pressing of a corresponding information key, first of all in an intermediate storage device of limited capacity, whose content is made visible for controlling by indicating means, and the information of the intermediate storage device is then transferred in groups to an utilization facility such as a magnetic tape or other storage device as soon as the intermediate storage device is filled up.

The process according to the invention can be carried out with an arrangement having a projection head and a projection surface for showing the pattern drawing, said projection head being provided with an illuminating and projecting optical means and with a scanning picture tube. The projection head and projection surface are adjustably mounted in a vertical direction relative to each other, and are adjustable by means of stepping motors in parallel planes. The arrangement includes a servicing push-button means, an intermediate storage device with optical control means, and a post-switched storage means.

The projection surface is effectively formed by an endless transport-band, the scanned picture tube of the projection head has a strongly framed central reading field, which projects the respective scanning points of the pattern drawing, and the position of the projection head is numerically pointed out by digital read-out tubes.

The intermediate storage device can therefore, for example, be constructed in the way of a five-digit electronic shift register, and its optical control device displays a number of adjacent, laterally spaced illumination fields, corresponding respectively to the number of stages of the intermediate storage device, such fields being arranged in the projection head next to the picture tube and are therefore within the viewing area of the operator. Each of the illumination fields is formed, respectively, at the end of a separate light-guiding rod, whose other end is located in the region of the rays of several independently actuable, differently colored lights. The operator has a push-button equipped console means at his disposal with several push-buttons representative of different information values, for instance different colors and additionally with a push-button for a step-switch motor, with a starter button, a line-end push-button, and with a starter for the step-switch motors for the arrangement and the correction of the position of the projection head.

The process according to the invention is therefore carried out with a semi-automatic arrangement, with which the scanning is carried out more slowly than with a fully automatic apparatus, but which has the big advantages that the existing pattern drawings do not have to be drawn carefully and that it is not necessary to make certain that the application of colors thereon is very even. If the central scanning field of the picture tube shows a color transition point on the drawing, the operator, who can also see the surrounding drawing areas on the picture tube, immediately decides which color button should be pushed and in which color therefore the corresponding pattern part afterwards should be reproduced on a textile machine. An other important advantage is that an immediate control through the keypunch of the fed material is possible and a correction of wrong information is made possible. The reading is sped up in such way, that in sections where the same information is repeated on the drawing during successive steps of the scan, a continuance key is operated, which enables an increased speed of step-by-step indexing of the projection surface. The storage device in which the information is fed line-by-line, may be made in different ways. Expediently a storage tape is used as an information storage device, in particular a perforated tape in connection with a perforated tape matrix and reading device. This perforated tape matrix and reading device may be equipped with a keyboard for an arbitrary use of the matrix device for the purpose of a correcting each track of the perforation tape.

A printing device is expediently attached to the storage device. The printing device has a multi-color pressure head and a pressure surface support, which are adjustable in a manner analogous to the projection surface and the application surface for the pattern design by means of step-by-step switching or indexing motors.

Details of the invention are shown in the following description in connection with the drawings, which show an illustrative embodiment of an information transmitter device according to the invention.

Figure 1:
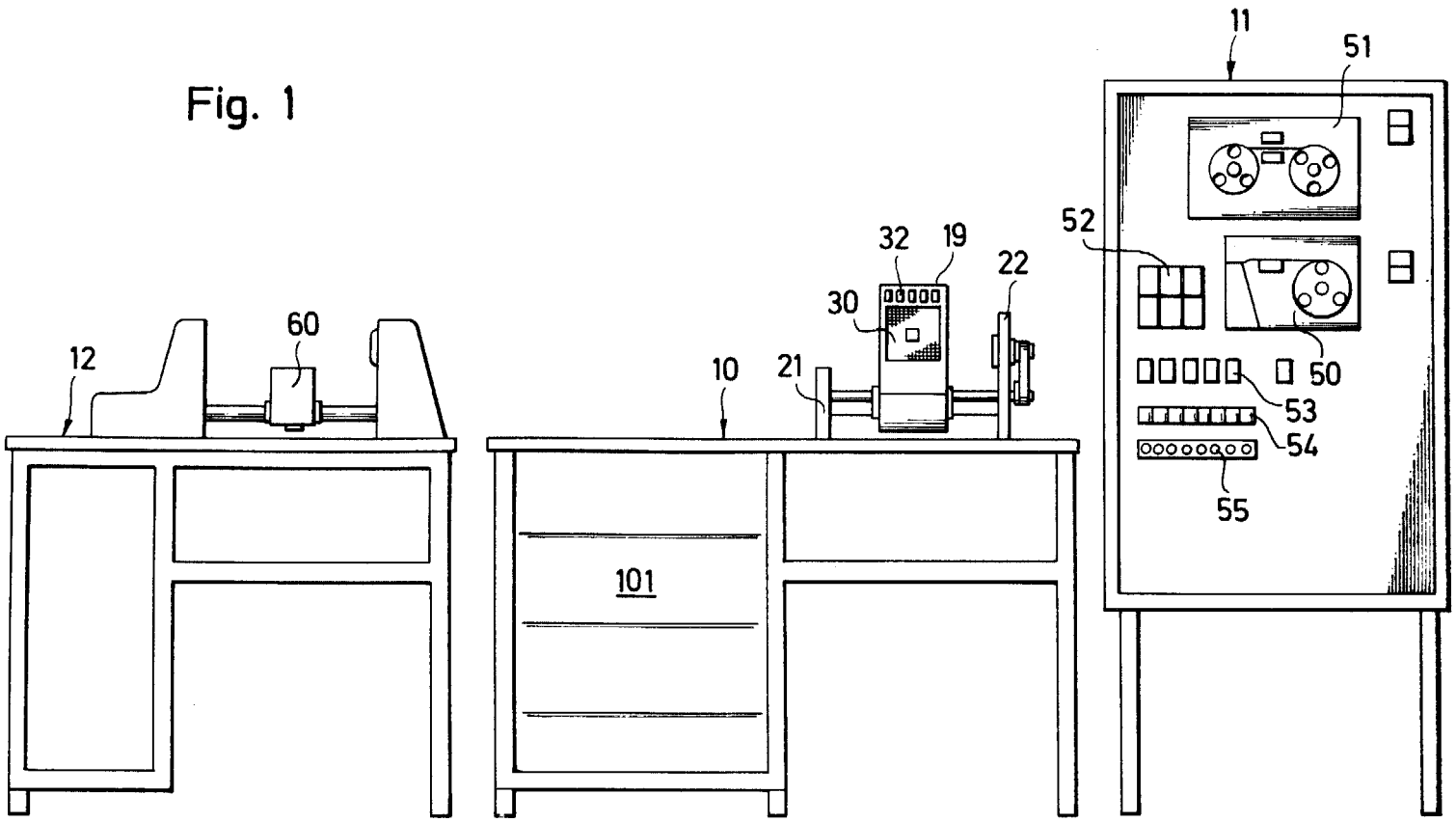
FIG. 1 is a veiw in elevation of a device according to the invention.

In FIG. 1 there is shown an installation for providing programs for controlling knitting machines on which there may be produced multi-colored knittings. The installation has a pattern table 10, a utilization facility such as a perforated tape matrix and reading unit 11, which forms no part of the instant invention, and a printing table 12.

Figure 3:
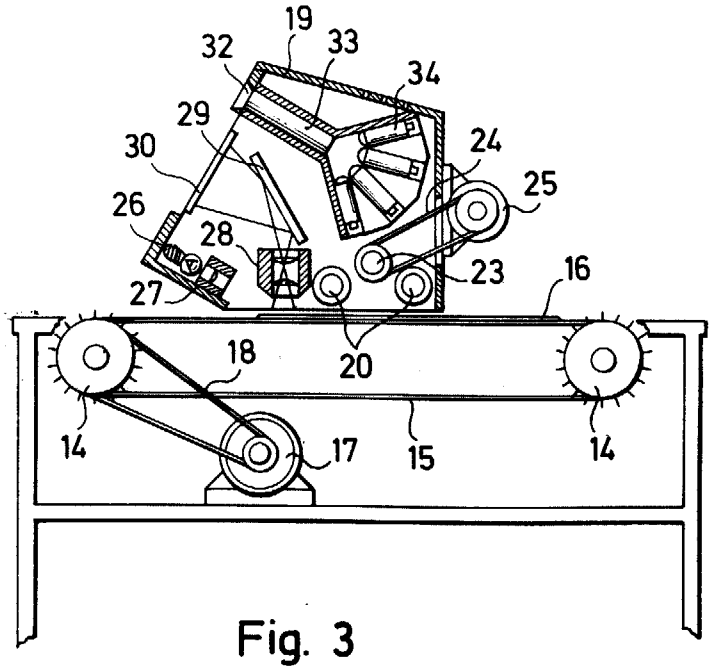
FIG. 3 is a schematic side view of a pattern table with a cross-section of the projection surface.
Figure 4:
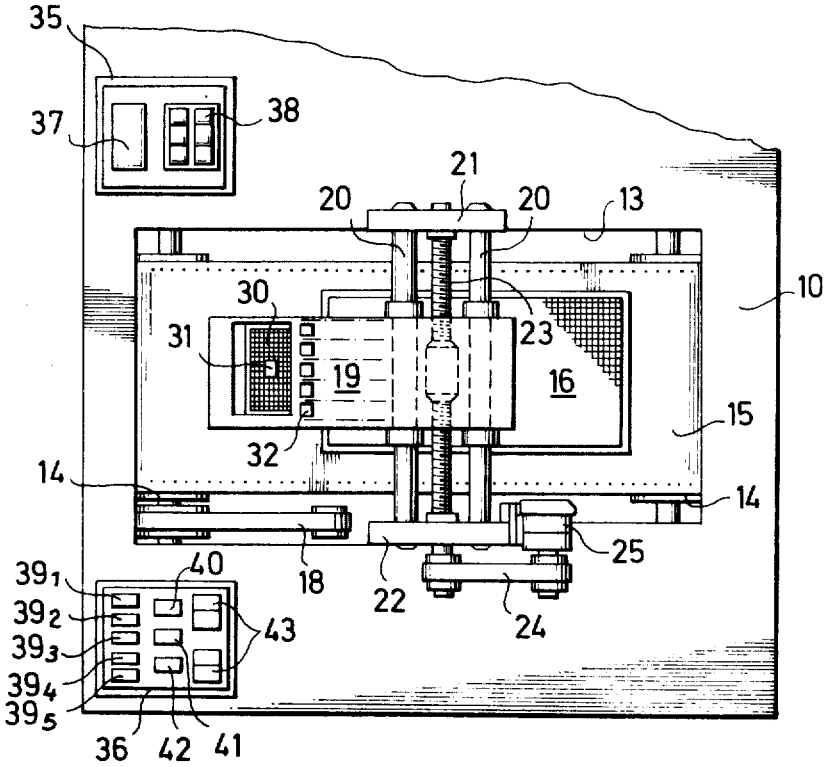
FIG. 4 is a view in plan of the pattern table.

The pattern table 10 according to FIGS. 3 and 4 has an opening 13 in its top of the opening being filled by an endless conveyor belt 15 entrained over two pin drums 14. This conveyor belt 15 serves as a surface to which a pattern drawing 16 may be detachably attached by means of adhesive tape. The conveyor belt 15 is driven by means of a step switch or stepping motor 17, which is connected by a driving belt 18 with the pin drum 14.

On the pattern table there is arranged a projection head 19 having an enclosed space therewithin, there being two horizontal parallel guiding sleeves 20 within head 19. The sleeves 20 are mounted on shafts mounted on end frames 21 and 22 supported on the pattern table 10. Both guiding sleeves 20 are movable at a right angle to the longitudinal direction of travel of the endless conveyor band 15, so that the projection head 19 can be moved crosswise to the length of the conveyor band 15 by means of screw 23 which is jornalled in the frames 21 and 22, screw 23 being threadedly engaged with a nut on the projection head 19 and being driven by a stepping motor 25, which is attached on frame 22, by means of a belt 24.

Figure 2:
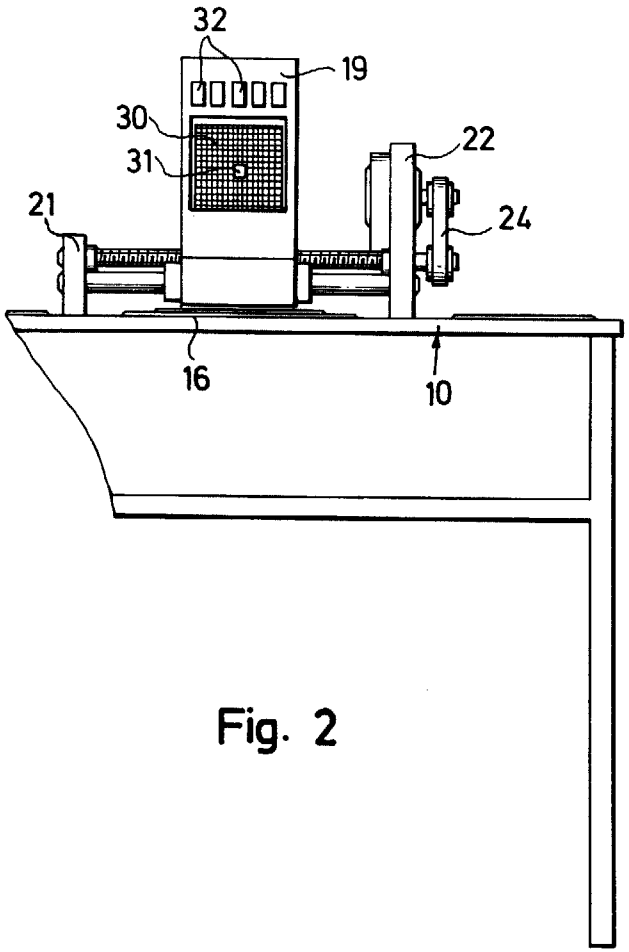
FIG. 2 is a fragmentary view on an enlarged scale of a pattern table.

As shown in FIG. 3, the projection head has a lamp 26 with an adjustable illumination lens 27, with which a desired area of the pattern drawing 16 on the conveyor band 15 can be illuminated. Above the illumination area in the projection head there is a projection means consisting of a lens system 28 and a mirror 29 with the aid of which the illuminated area of the pattern drawing is projected on a screen 30 which is arranged on the front side of projection head 19. As shown in FIGS. 2 and 3, the screen 30 is divided by means of scanning lines into square fields; in its middle the screen 30 is provided with a strongly outlined reading field 31. Through the scanning of the screen 30 freehand pattern drawings 16 will be automatically subdivided into sub-areas of a mesh or grid field. Above the screen 30 in head 19 there are five laterally spaced illumination fields 32 (FIG. 4) which appear on the ends of five respective light transmitting rods 33 (FIG. 3) the longitudinal sides of which are mirrored. The other end of each of rods 33 lies in the area of illumination provided by four lamps 34, each of such lamps projecting a different colored light. The lamps 34 are energizable by conventional means (not shown) via color keys $39_1$–$39_5$, one of such keys serving to trigger two of the lamps simultaneously to yield white light as indicated below. In the top of the pattern table 10 there are mounted two control panels 35 and 36. Panel 35 has a key 37 for the selective operation of the stepping motor 25 by triggering a conventional motor actuation means (not shown), as well as six transportation keys 38, which permit the correct initial posittioning of the projection head with respect to the pattern drawing 16 attached to the band 15, and the correction of the position of the projection head with respect to conveyor band when necessary. The keys 38 are also connected to trigger a conventional actuating means (not shown) for the motor 25. The control panel 36 is provided with three additional keys 40, 41, and 42, of which key 40 functions to register the end of a line in storage as described below, key 41 acts to start the stepping movements of the conveyor band 15 and key 42 acts to initiate a so-called reading return in which the step switch motors 17 and 25 are reversed. It will be understood that the keys 40–42 are also suitably coupled to conventional driving means (not shown) for the respective motors 17 and 25 to perform the indicated functions. In the control panel 36 there are also mounted two digital readout tubes 43, who show the numbers of spots of the pattern drawing 16 scanned by the projection head. In FIG. 1 the pattern table 10 is shown as having an interim storage device attached to it: device 101, which is not specifically shown in the drawing, can be, for example, a five digit electronic slide register. The keys 39 are suitably coupled to the interim storage device 101 in a conventional manner so that the successive actuation of a key 39 successively shifts the contents of the storage device 101 in a corresponding manner, with the information dictated by the last key to be actuated being entered in the first stage of the register. Additionally, the register 101 is suitably arranged to be cleared upon (1) the actuation of a key 39 following the filling of the highest order stage of the register and (2) upon the depression of the key 40 signalling the end of a line.

The apparatus thus far described functions as follows: After producing a pattern design 16, e.g. a freehand design on blank paper, and mounting it on the conveyor band 15, the projection head 19 and the conveyor band 15 are so shifted that the projection of the top spot of the pattern line falls in the central pattern field 31 on the screen 30. The corresponding adjustment is effected by the operator through the keys 38. After this, the installation is switched on by pushing start key 41 into a semi-automatic operating position, and thereafter the other installation parts of the pattern table are rendered active. Thus, upon pushing one of the colored keys 39, through $39_5$, or by pushing the continuance step key 37, the projection head 19 is shifted step-by-step in the direction of a line of the pattern design; by pushing line end key 40 the endless conveyor band 15 is switched ahead by one line-step and the projection head 19 simultaneously carried back to its starting position. If the operator pushes reading return key 42, the above explained operation of projection head 19 and conveyor band 15 are reversed. This happens when pattern designs exist, where the pattern lines consist of more than 250 meshes. These bigger pattern designs are turned through 90° and attached on conveyor band 15, so that the pattern line of the drawing proceed at right angles to the conveyor band. By pushing a color key 39 or a continuance key 37, the conveyor band 15 is moved step-by-step, wherein in one line up to 999 steps (the same as the number of meshes) may occur: by pushing of line end key 40 the projection head 19 is moved in a line crosswise to the conveyor band 15 and the conveyor band 15 is moved back to its initial point, so that the starting point of the next line shows on the reading field 31 on the screen 33. The operator, after positioning the installation so that the first point of the first line of the pattern design lies in the reading field 31, and after determining the predominant color of such first point pushes the corresponding color key 39. Through this the corresponding color value is put in the lowset order stage of the interim storage device 101, and in the first of the five illuminating fields 32 lights up with the selected color. Such color corresponds with the color in the reading field 31. The illuminating fields 32 immediately produce a control of the proper operation of color key 39. If key $39_1$, for example, corresponds to the color red, the bulb 34 of the first illuminating field 32 lights up. By pushing color key 39 reading head 19 is moved by one key step through the stepping motor 25. If the same color appears again in reading field 31, color key and continuance step key 37 are pushed down together and an accelerated step-by-step continuing switching of the projection head is produced, such stepping continuing until the freeing of the continuance step key 37. The operator not only is able to survey on screen 30 the reading field 31 but also the adjacent areas of the pattern design, and the color distribution therein, up to where another color area moves up to the reading field 31. With each push of the keys the colors shown on the illuminating fields are displaced, which means that with the second pushing of the key the first color shown in the first indication field 32 moves into the adjacent second indication field 32 and the first indication field shows the new (or the same) color produced by the second push key, and the stepping of the interim storage means proceeds in a corresponding manner. After five feeding processes five corresponding information bits are kept in the interim storage device 101 and all illuminating fields are occupied. Therefore with the sixth feeding step, the contents of the five stages of the interim storage device 101 is shifted to the tape punch and reading device 11 and the interim storage device is cleared. There is therefore always a possibility of control over an area up to five feeding steps. In case of a wrongly pushed key, the fed information can be cleared by a actuation of a clearing key (not shown) conventionally connected in the circuit to disable the lamps 34 and to empty the intermediate storage means 101, and projection head 19 can simultaneously be readjusted from the wrongly selected spot. As soon as the end of a line is reached, line end key 40 is operated, which results in emptying the interim storage means, projection head 19 then being returned to its initial position and conveyor band 15 with the pattern 16 thereon being switched forward by one line. By operating the line end key, a line end sign is registered in the storage: thus in the disclosed embodiment the punch device of unit 11 punches a line-end sign on the perforation tape. The five color keys $39_1$–$39_5$ shown should, for example, be selected for the colors white, red, blue, yellow, and green. For these five colors only four bulbs are necessary, since the green light is produced by a simultaneous lightning up of a yellow bulb 34 and a blue bulb 34. The perforation tape-punch and reading unit 11 has a tape punch device 50 and a tape reading device 51. Moreover, it is equipped with a correction device having six selection keys 52 which are suitably connected in the circuit by conventional means (not shown) to forward to the digital read-out tubes 43 of the pattern table the pattern image points on which a correction has to be made. Moreover, the correction part has five color keys 53, eight correction keys 54, and eight arranged indication bulbs 55, all suitably arranged and connected in the circuit in a conventional manner to perform the functions indicated below.

If correction is necessary, the coordination point of the to be corrected pattern point is identified by keys 52 and the perforation tape puncher 50 reproduces up to this marked pattern point a new perforation tape according to the information on the old tape. The right information for the corrected pattern point is fed with the aid of color key 53, whereas the information contained in the last line of the perforation tape is indicated by the eight bulbs 55. Further information can be fed by the eight correction keys 54, so that a pattern information on an eight track perforation tape may also be given over the eight correction keys 54 of the unit 11.

Figure 5:
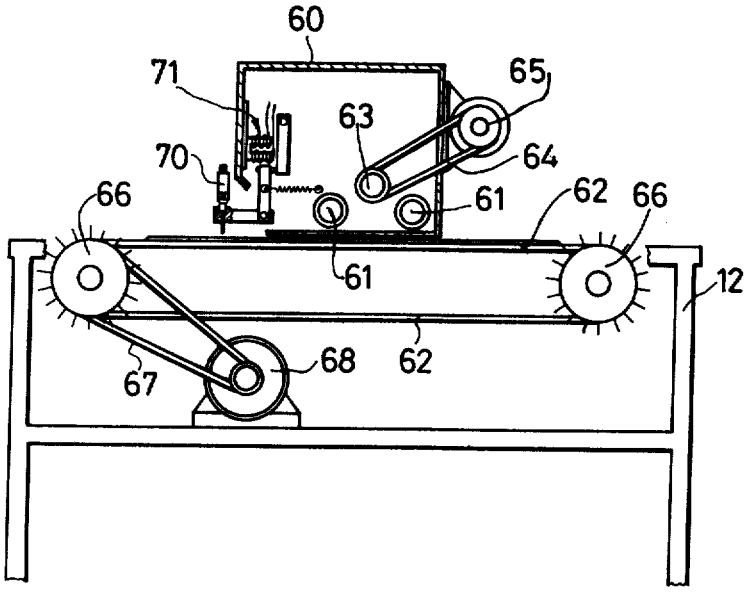
FIG. 5 is a schematic side view of a printing table with a cross-section of the printing apparatus.
Figure 6:
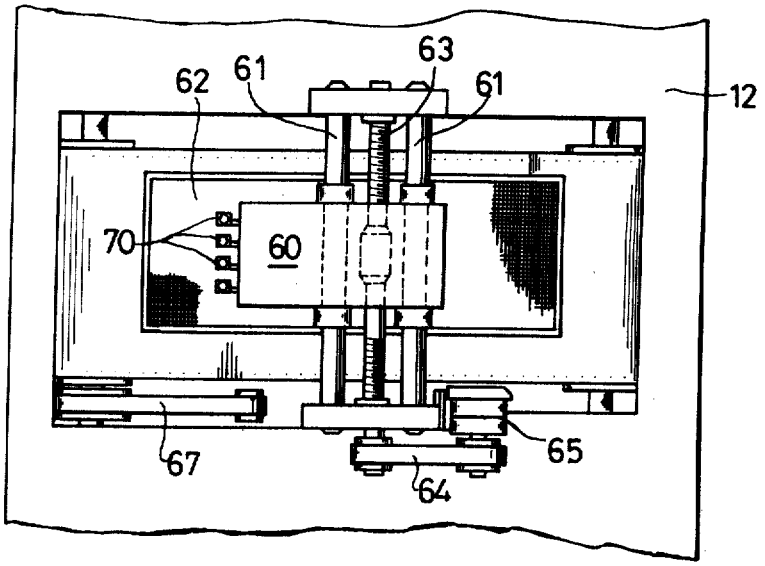
FIG. 6 is a view in plan of the printing table and printing apparatus.

With the printing device 12 shown in FIG. 1, the information contents of a perforated tape produced in unit 11 can be printed as a multi-color pattern sheet, and through this an overall control of the stored pattern may be obtained without having to knit a specimen thereof. The printing device 12, which is shown in detail in FIGS. 5 and 6, has a multi-color printing head 60 which can be adjusted crosswise analogous to the adjustment of the projection head 19 of the pattern table, to a conveyor band 62, entrained over rolls 66 on which there is attached a foil to be printed. The head 60 is adjustably mounted on two guiding rolls 61. The construction of the printing device 12 is similar to the construction of the pattern table 10. The printing head is made as a four color printing head, since the fifth color is created through the bottom of the printing foil. The printing device is also equipped with a conventional interim storage means (not shown) which stores the information of a sheet line. The printing head runs through the same sheet line four times, printing in a different color each time at the corresponding spots.

The adjusting of the multicolored printing head 60 is produced by a cross screw 63, driven by a switching motor 65 via a driving belt 64. One of rolls is driven via a driving belt 67 by a switching motor 68. The multicolored printing head 60 is, in the example shown, a four-colored printing head. A fifth color is supplied by the color of the base of the printing foil. For each color there is provided a separate printing pin 70, which is actuated by an electromagnetic drive 71 arranged in the printing head 60. The driving device 71 will be fed with working impulses via an intermediate storage 57 (FIG. 7, to be described) by which the impulses for the different printing pins 70 may be stored at different times in the switching registers 58. The multi-colored printing head 60 runs four times through the same sheet line; at each time it prints with a different one of the four printing pins 70 at the program station.

The storage means does not have to use a perforation tape punch device, but can instead employ a magnetic tape registering and reading unit. The conveyed information could also be fed directly into a storage means of a computer.

Figure 7:
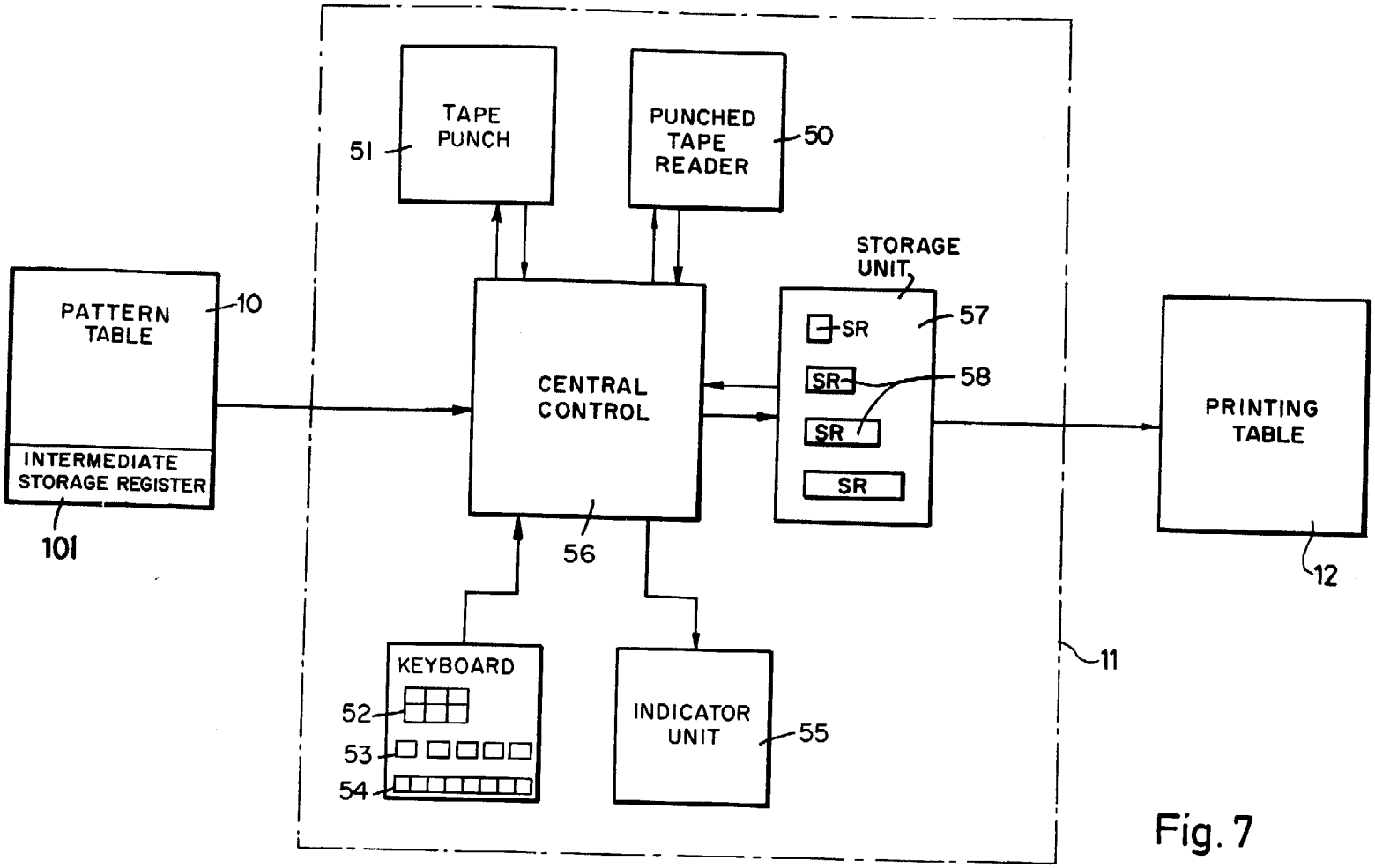
FIG. 7 is a block diagram of the control mechanism for the apparatus of the invention.

FIG. 7 is a block diagram indicating generally with arrows how each of the parts of the above-described arrangement are operatively connected with each other. The perforated tape matrix and reading unit 11 has a conventional central electronic control 56, through which single parts of the arrangement may be coupled selectively with each other. In association with the electronic control 56 within the perforated tape matrix and reading unit 11 there are conventionally arranged a perforation punch device 50, a perforation reading device 51, several selection keys, i.e. 52 to 54, and indication bulbs 55. The central electronic control 56 is further coupled outside unit 11 with the pattern table 10 via a storage means 57 and is also connected with the printing table 12, all in a conventional manner.

With the aid of the central electronic control 56 the information read from pattern table 10 may be transmitted to the perforation punch device 50 and stored thereby in a perforation tape. Via the central electronic control 56 and from the perforation reading device 51 the information taken from a perforation tape may be transmitted via the storage means 57 to the printing table 12. The storage means 57 contains several switch registers 58 as storage means of different numbers, shown with respective boxes of different sizes and lengths. The intermediate storage 57 with its different sized switching register 58 causes the signals for the different colors to be conducted and inserted at different times to the printing arrangement of the printing table 12. The central electronic control means 56 also transmits information manually via different push-buttons 52 to 54 in the perforation punch device.

Although the invention is illustrated and described with reference to a plurality of preferred embodiments, it is to be expressly understood that it is in no way limited to the disclosure of such a plurality of preferred embodiments, but is capable of numerous modifications within the scope of the appended claims.

What is claimed is:

1. A method for processing the information content of a pattern drawing in coded form in preparation for application of said content to a utilization device wherein the information of each discrete portion of a line of the pattern includes a unique characteristic such as color, which comprises the steps of scanning each line of the drawing in stepwise fashion so as to scan successive discrete areas in each line, illuminating and projecting each of said scanned areas of each line in succession upon a projection screen for observing the unique characteristics of said succession of areas, entering the unique characteristics of a scanned area then in registration with a prescribed location on the screen into the lowest order stage of a shift register that has a plurality of stages less than the number of discrete areas of each line of the pattern drawing, and selectively clearing the register and simultaneously outpulsing all the information stored therein when the register is filled and when the scanning of a line of the pattern drawing is complete.

2. Apparatus for processing the information content of a pattern drawing in coded form in preparation for application of said content to a utilization device wherein the information of each discrete portion of a line includes a unique characteristic such a color, comprising means for scanning each line of the drawing in stepwise fashion so as to scan successive discrete areas in each line, a projection screen, means for illuminating and projecting each of said scanned discrete areas in each line in succession upon the screen for observing the unique characteristics of said succession of areas, an interim storage means including a shift register having a fixed plurality of successively higher order stages whose number is less than the number of discrete areas in each line for storing the information derived from a corresponding plurality of the successively scanned discrete areas of a line of the pattern drawing, first keying means individually associated with a different one of said unique characteristics of said discrete areas and operable for entering in the lowest order stage of said shift register the unique characteristic of the scanned discrete area then in registration with a prescribed location of the projection screen, and second keying means selectively operable upon the filling of the shift register and upon the completion of scan of the line of the drawing for clearing the register and for outpulsing the said information contained therein concerning the fixed plurality of said discrete areas of the scanned line of the pattern drawing as a group.

3. Apparatus according to claim 2, comprising a projection head carrying projection means and a conveyor carrying the pattern drawing and means for moving the projecting head and the conveyor step by step, said last named means comprising stepping motors controllable by an operator viewing the projection screen.

4. Apparatus according to claim 3, wherein the conveyor is an endless band conveyor.

5. Apparatus according to claim 3, wherein the scanning screen is mounted on the projection head, said screen having markings thereon forming a strongly framed central reading field which defines the respective scanning area of the pattern design, said central reading field defining the prescribed location on the screen.

6. Apparatus according to claim 3, comprising indication tubes to indicate of the position of the projection head.

7. Apparatus according to claim 2, comprising an optical indication device for the interim storage means, said indication device having a number of adjacent illumination fields corresponding in number to the number of stages of the interim storage means.

8. Apparatus according to claim 7, wherein the optical indication device has a plurality of light-transmitting rods with one end of each rod disposed adjacent an associated one of the respective fields, the other end of each rod being disposed adjacent a plurality of colored light bulbs.

* * * * *